US008106793B2

(12) United States Patent
Chang et al.

(10) Patent No.: US 8,106,793 B2
(45) Date of Patent: Jan. 31, 2012

(54) SYSTEM AND METHOD FOR COLLECTING TRAFFIC VIOLATION DATA

(75) Inventors: Chi-Hao Chang, Tu-Cheng (TW); Tsung-Yuan Huang, Tu-Cheng (TW); Lei Pi, Taipei Hsien (TW)

(73) Assignee: Chi Mei Communication Systems, Inc., Tu-Cheng, New Taipei (TW)

( * ) Notice: Subject to any disclaimer, the term of this patent is extended or adjusted under 35 U.S.C. 154(b) by 414 days.

(21) Appl. No.: 12/476,237

(22) Filed: Jun. 1, 2009

(65) Prior Publication Data

US 2009/0325638 A1 Dec. 31, 2009

(30) Foreign Application Priority Data

Jun. 30, 2008 (CN) ..... 2008 1 0302419

(51) Int. Cl.
*G08G 1/017* (2006.01)
*G08G 1/054* (2006.01)

(52) U.S. Cl. ..... 340/937; 340/933; 348/148

(58) Field of Classification Search ..... 340/937, 340/933, 541; 348/143, 148, E7.085; 382/100, 382/104; 701/35
See application file for complete search history.

(56) References Cited

U.S. PATENT DOCUMENTS

| | | | | |
|---|---|---|---|---|
| 5,432,547 | A * | 7/1995 | Toyama | 340/937 |
| 6,188,329 | B1 * | 2/2001 | Glier et al. | 340/933 |
| 6,718,239 | B2 * | 4/2004 | Rayner | 340/937 |
| 2003/0214585 | A1 * | 11/2003 | Bakewell | 348/148 |
| 2006/0269104 | A1 * | 11/2006 | Ciolli | 382/104 |
| 2010/0134623 | A1 * | 6/2010 | Sakaguchi et al. | 348/148 |

FOREIGN PATENT DOCUMENTS

CN 101044512 A 9/2007

* cited by examiner

*Primary Examiner* — John A Tweel, Jr.
(74) *Attorney, Agent, or Firm* — Altis Law Group, Inc.

(57) ABSTRACT

A system and method for collecting traffic violation data sets at least one possible traffic violation item in the electronic device, selects a corresponding traffic violation item when a traffic violation occurs, and activates a CCD camera of an electronic device to capture an image of the traffic violation. The system and method further uses an assisted global position system (A-GPS) to obtain location information and time information of the traffic violation, verifies access of a user of the electronic device, and transmits the image, the location information, the time information and the digital certificate to a traffic management server to process the traffic violation.

12 Claims, 2 Drawing Sheets

SYSTEM AND METHOD FOR COLLECTING TRAFFIC VIOLATION DATA

BACKGROUND

1. Technical Field

Embodiments of the present disclosure are related to data management, and particularly to a system and method for collecting traffic violation data through an electronic device.

2. Description of Related Art

Nowadays, traffic violation citations are recorded manually by the police. The recorded information includes location information, time information, driver name of the traffic violation, and so on. Because the recorded information is inputted manually, it is prone to mistakes and the efficiency is very low.

What is needed, therefore, is an improved system and method for collecting traffic violation data to overcome the above-stated problems.

DETAILED DESCRIPTION

All of the processes described may be embodied in, and fully automated via, functional code modules executed by one or more general purpose computers or processors. The code modules may be stored in any type of computer-readable medium or other storage device. Some or all of the methods may alternatively be embodied in specialized computer hardware or electronic apparatus.

Figure 1:
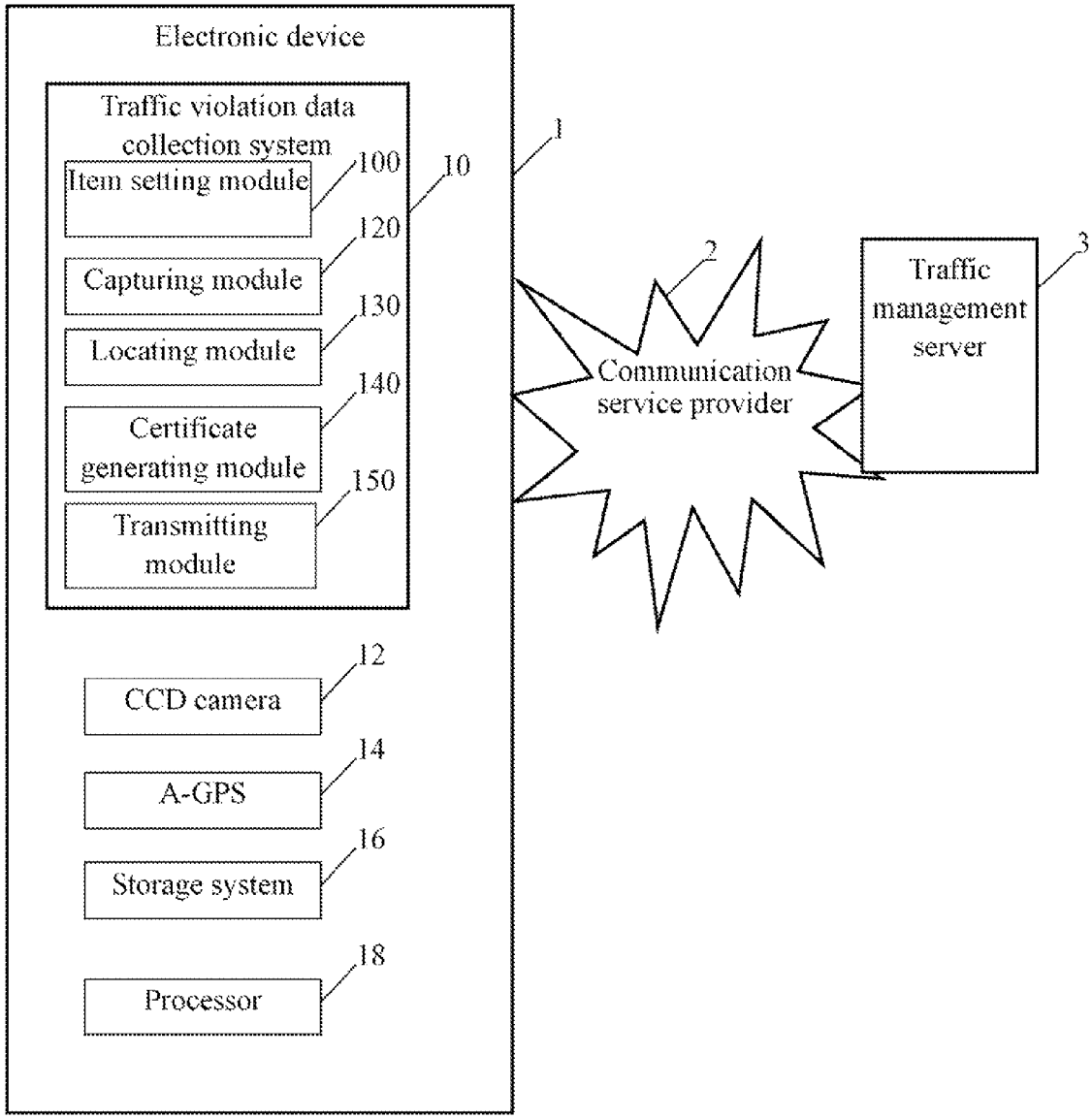
FIG. 1 is a block diagram of one embodiment of a system for collecting traffic violation data using an electronic device.

FIG. 1 is a block diagram of one embodiment of a traffic violation data collection system 10 of an electronic device 1. In one embodiment, the electronic device 1 includes a charge coupled device (CCD) camera 12, an assisted global position system (A-GPS) 14, a storage system 16, and a processor 18. The CCD camera 12 captures at least one image of a traffic violation when a violation occurs. The A-GPS 14 locates a position of the traffic violation so as to obtain location information and time information of the traffic violation. A-GPS is a defined industry standard. The term "assisted" in A-GPS refers to how to use network resources to provide a more robust measurement when only two satellites are visible.

The storage system 16 stores one or more programs, such as computerized codes of the traffic violation data collection system 10, programs of an operating system, and other applications of the electronic device 1. In one embodiment, the electronic device 1 may be a mobile phone or a personal digital assistant, and the storage system 16 may be an external storage card, e.g., a smart media card, a secure digital card, a compact flash card, or any other type of memory card. The processor 18 executes programs of the traffic violation system 10 and the other applications, to provide functions of the electronic device 1.

The electronic device 1 collects traffic violation data, and transmits the traffic violation data to a traffic management server 3 to process the traffic violation via a communication service provider, such as China Mobile, China Telecom, for example. In one embodiment, the traffic management server 3 may be a server system serving the traffic police.

In one embodiment, the traffic violation data collection system 10 includes an item setting module 100, a capturing module 120, a locating module 130, a certificate generating module 140, and a transmitting module 150. The modules 100, 120, 130, 140, and 150 may be used to execute one or more operations for the traffic violation data collection system 10.

The item setting module 100 sets at least one traffic violation item, and stores the traffic violation item in the storage system 16 of the electronic device 1. In one embodiment, the traffic violation item includes all kinds of traffic violation situations, but not limited to, a speed limit violation, a driving on the wrong lane violation, a tail gating violation, for example.

The capturing module 120 actives the CCD camera 12 to capture an image of a traffic violation when a traffic violation occurs and at least one traffic violation item is selected by user of the electronic device 1 correspondingly.

The locating module 130 locates a position of the traffic violation to obtain location information and time and date information by using the A-GPS 14.

The certificate generating module 140 verifies the authenticity of a user trying to access the electronic device 1. In one example, the certificate generating module 140 verifies the authenticity by generating a digital certificate of the user account accessing the electronic device.

The transmitting module 150 transmits the image, the location information, the time information, and the generated digital certificate to the traffic management server 3 via a multimedia message service message (MMS message), in one example. The police may process the traffic violation by using the traffic violation collection data stored in the traffic management server 3.

Figure 2:
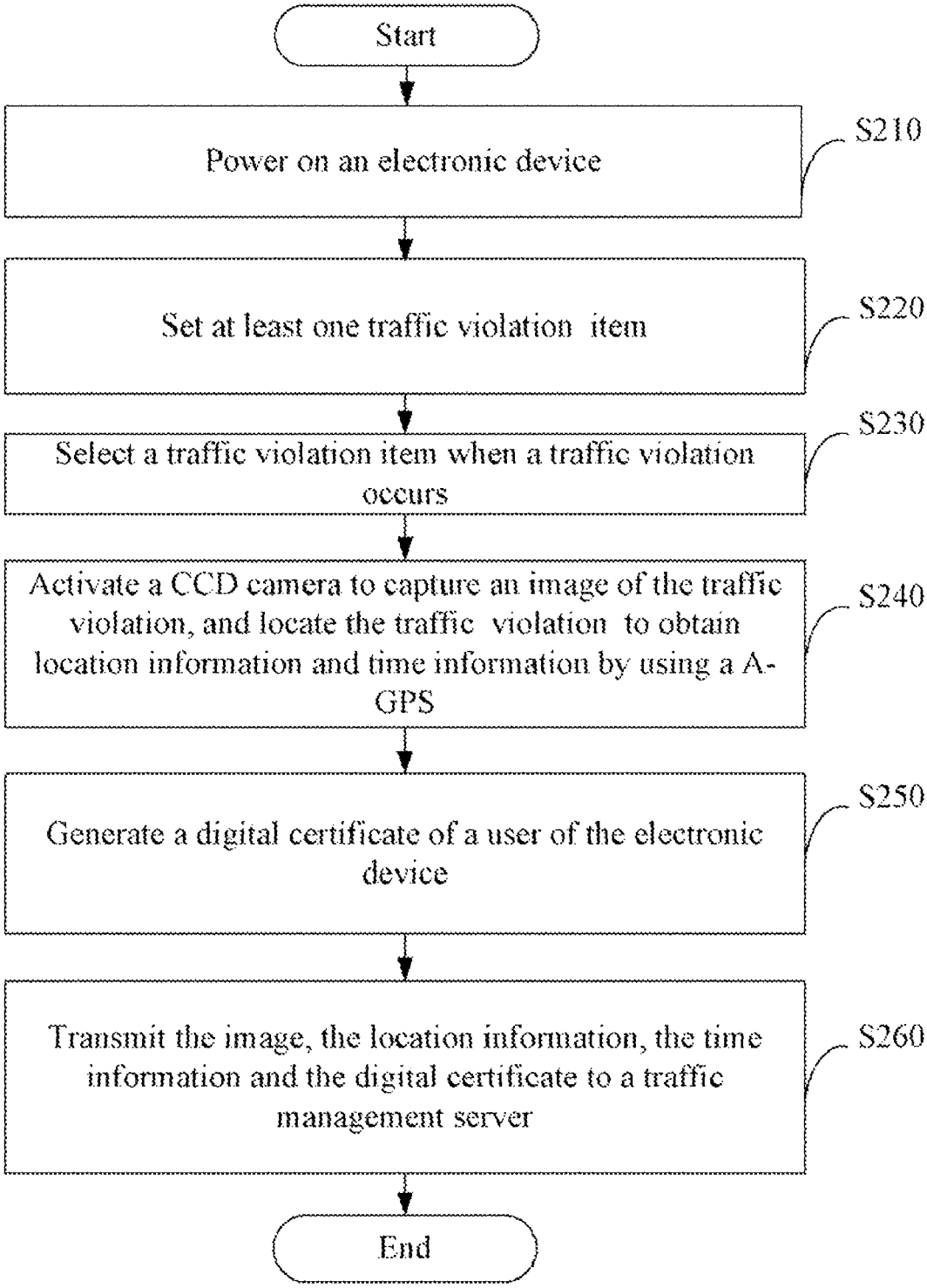
FIG. 2 is a flowchart of one embodiment of a method for collecting traffic violation data using the electronic device.

FIG. 2 is a flowchart of one embodiment of a method of collecting traffic violation data by using the electronic device 1. Depending on the embodiment, additional blocks may be added, others removed, and the ordering of the blocks may be changed.

In block S210, the electronic device 1 is powered on.

In block S220, the item setting module 100 sets at least one traffic violation item, and stores the at least one traffic violation item in the storage system 16 of the electronic device 1. In one embodiment, the at least one traffic violation item includes all kinds of traffic violation situations, such as, speed limit violation, driving in the wrong lane, tail gating and so on.

In block S230, the user selects a traffic violation item when a traffic violation occurs.

In block S240, the capturing module 120 actives the CCD camera 12 to capture an image of a traffic violation when the traffic violation occurs and the user selects at least one corresponding traffic violation item. The locating module 130 locates the traffic violation to obtain location information and time information by using the A-GPS 14.

In block S250, the certificate generating module 140 verifies the authenticity of a user trying to access the electronic device 1. In one example, the certificate generating module 120 verifies the authenticity by generating a digital certificate of the user account accessing the electronic device.

In block S260, the transmitting module 150 transmits the image, the location information, the time information with the generated digital certificate to the traffic management server 3 via a multimedia message service message (MMS message), in one example. The police may process the traffic violation by using the traffic violation collection data stored in the traffic management server 3.

The above embodiments automatically collect data on traffic violation and transmit the traffic violation data to the traffic management server to process the traffic violation, which avoid the inconvenient operation of the police when the traffic violation occurs.

It should be emphasized that the above-described inventive embodiments are merely possible examples of implementations, and set forth for a clear understanding of the principles of the present disclosure. Many variations and modifications may be made to the above-described inventive embodiments without departing substantially from the spirit and principles of the present disclosure. All such modifications and variations are intended to be included herein within the scope of this disclosure and the above-described inventive embodiments, and the present disclosure is protected by the following claims.

What is claimed is:

1. A method for collecting traffic violation data through an electronic device, the electronic device including a charge coupled device (CCD) camera and an assisted global position system (A-GPS), the method comprising:

setting at least one possible traffic violation item in the electronic device;

selecting a corresponding traffic violation item when a traffic violation occurs;

activating the CCD camera to capture an image of the traffic violation, and locating a position of the traffic violation to obtain location information and time information of the traffic violation by using the A-GPS;

verifying access of a user of the electronic device by generating a digital certificate of the user accessing the electronic device; and transmitting the image, the location information, the time information and the digital certificate to a traffic management server to process the traffic violation.

2. The method as claims in claim 1, wherein the image, the location information, the time information and the digital certificate are transmitted via a multimedia message service message.

3. The method as claims in claim 1, wherein the electronic device is a mobile phone or a personal digital assistant.

4. A computer-based system for collecting traffic violation data through an electronic device, the system comprising:

a storage system;

at least one processor; and one or more programs stored in the storage system and being executable by the at least one processor, the one or more programs comprising:

an item setting module to set at least one possible traffic violation item in the electronic device;

a capturing module to capture an image of the traffic violation after selecting a corresponding traffic violation item when a traffic violation occurs;

a locating module to locate the traffic violation to obtain location information and time information of the traffic violation;

a certificate generating module to verify access of a user of the electronic device by generating a digital certificate of the user accessing the electronic device; and a transmitting module to transmit the image, the location information, the time information and the digital certificate to a traffic management server to process the traffic violation.

5. The system as claimed in claim 4, wherein the image, the location information and the time information are transmitted via a multimedia message service message.

6. The system as claimed in claim 4, wherein the capturing module is a charge coupled device (CCD) camera.

7. The system as claimed in claim 4, wherein the locating module locates the traffic violation by using an assisted global position system (A-GPS).

8. The system as claimed in claim 4, wherein the storage system is selected from the group consisting of a smart media card, a secure digital card, and a compact flash card.

9. The system as claimed in claim 4, wherein the electronic device is a mobile phone or a personal digital assistant.

10. A storage medium storing a set of instructions, the set of instructions capable of being executed by a processor to perform a method for collecting traffic violation data through an electronic device, the electronic device having a charge coupled device (CCD) camera and an assisted global position system (A-GPS), the method comprising:

setting at least one possible traffic violation item in the electronic device;

selecting a corresponding traffic violation item when a traffic violation occurs;

activating the CCD camera to capture an image of the traffic violation, and locating a position of the traffic violation to obtain location information and time information of the traffic violation by using the A-GPS;

verifying access of a user of the electronic device by generating a digital certificate of the user accessing the electronic device; and transmitting the image, the location information, the time information and the digital certificate to a traffic management server to process the traffic violation.

11. The storage medium as claimed in claim 10, wherein the image, the location information, the time information and the digital certificate are transmitted via a multimedia message service message.

12. The storage medium as claimed in claim 10, wherein the electronic device is a mobile phone or a personal digital assistant.

* * * * *